US006377175B1

(12) United States Patent
Williams

(10) Patent No.: US 6,377,175 B1
(45) Date of Patent: Apr. 23, 2002

(54) SYSTEM FOR DETECTING THE PRESENCE OF INDIVIDUAL GOLF CLUBS IN A GOLF BAG

(76) Inventor: Preston Williams, 29140 Brooks La., Southfield, MI (US) 48034

( * ) Notice: Subject to any disclaimer, the term of this patent is extended or adjusted under 35 U.S.C. 154(b) by 0 days.

(21) Appl. No.: 09/648,242

(22) Filed: Aug. 25, 2000

(51) Int. Cl.[7] ..... G08B 13/14

(52) U.S. Cl. ..... 340/568.6; 340/572.1; 206/315.3; 206/315.6

(58) Field of Search ..... 340/568.6, 572.1; 206/315.3, 315.6

(56) References Cited

U.S. PATENT DOCUMENTS 3,988,724 A 10/1976 Anderson
5,132,622 A 7/1992 Valentino
5,289,163 A 2/1994 Perez et al.
D372,679 S 8/1996 Giannini
5,565,845 A * 10/1996 Hara ..... 340/568
5,844,483 A 12/1998 Boley
5,952,921 A 9/1999 Donnelly
6,023,225 A * 2/2000 Boley et al. ..... 340/568.6

* cited by examiner

*Primary Examiner*—Daryl Pope

(57) ABSTRACT

A system for detecting the presence of individual golf clubs in a golf bag. The system includes a club monitoring device which is mountable in the interior of the golf bag for detecting the presence of at least one golf club in the interior of the golf bag, the club monitoring device comprising: a plurality of sensor units, each of the sensor units defining a gap for removably receiving one of the plurality of the golf clubs; and a control unit connected to each of the sensor units, the control unit indicating when one of the sensor units does not detect the presence of a golf club in the gap defined by the sensor unit, wherein the control unit has an indicator for indicating that at least one of the sensor units does not detect the presence of a golf club in the associated club receiving member.

16 Claims, 4 Drawing Sheets

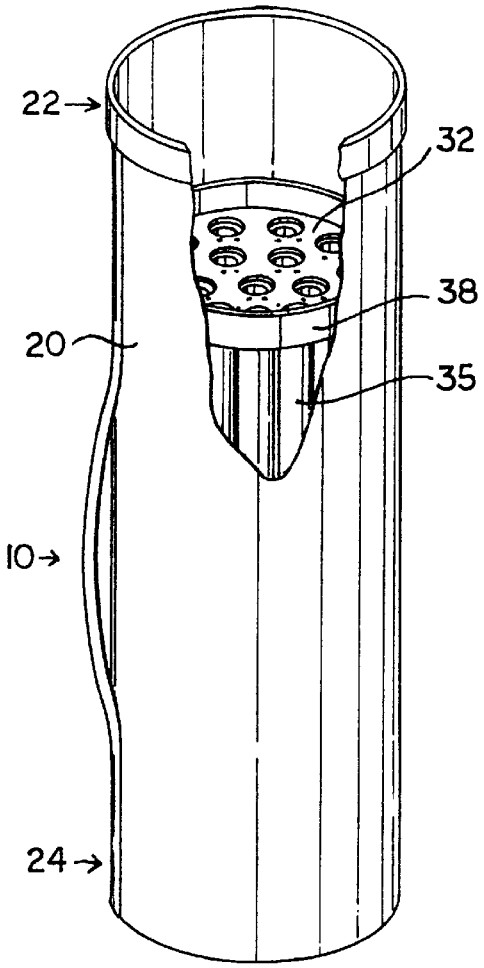
FIG. 1
FIG. 2
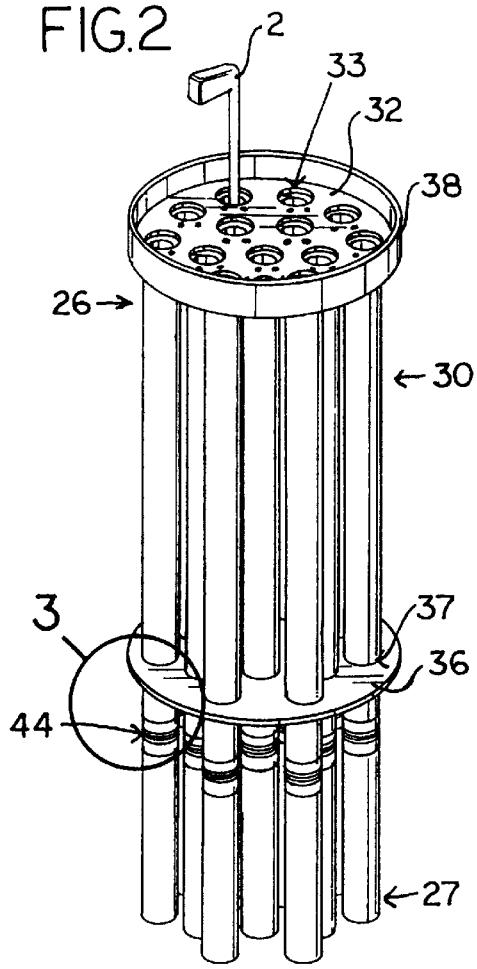
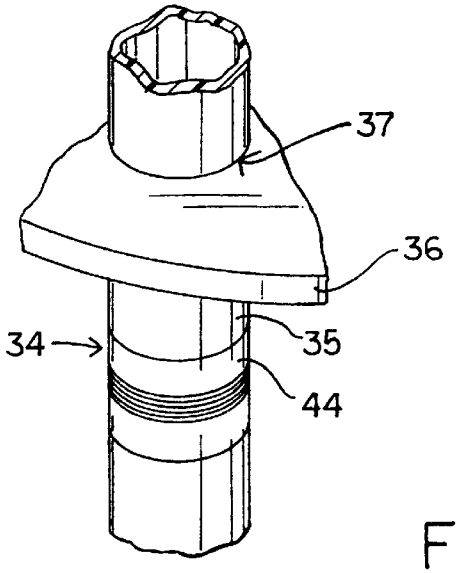
FIG. 3

FIG. 5
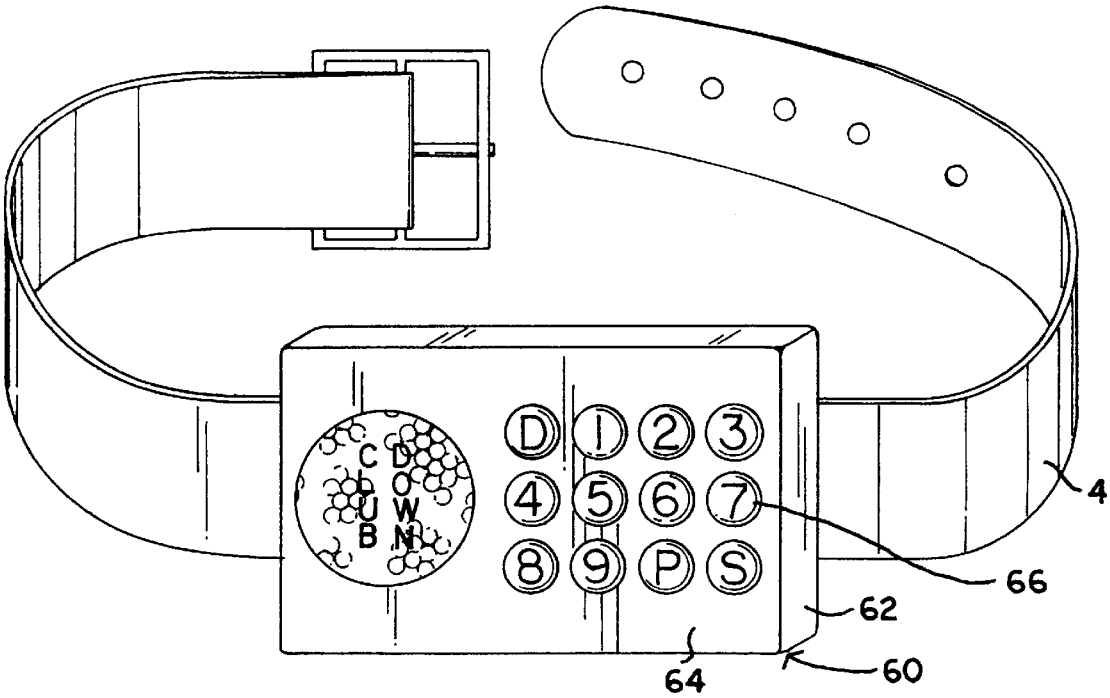
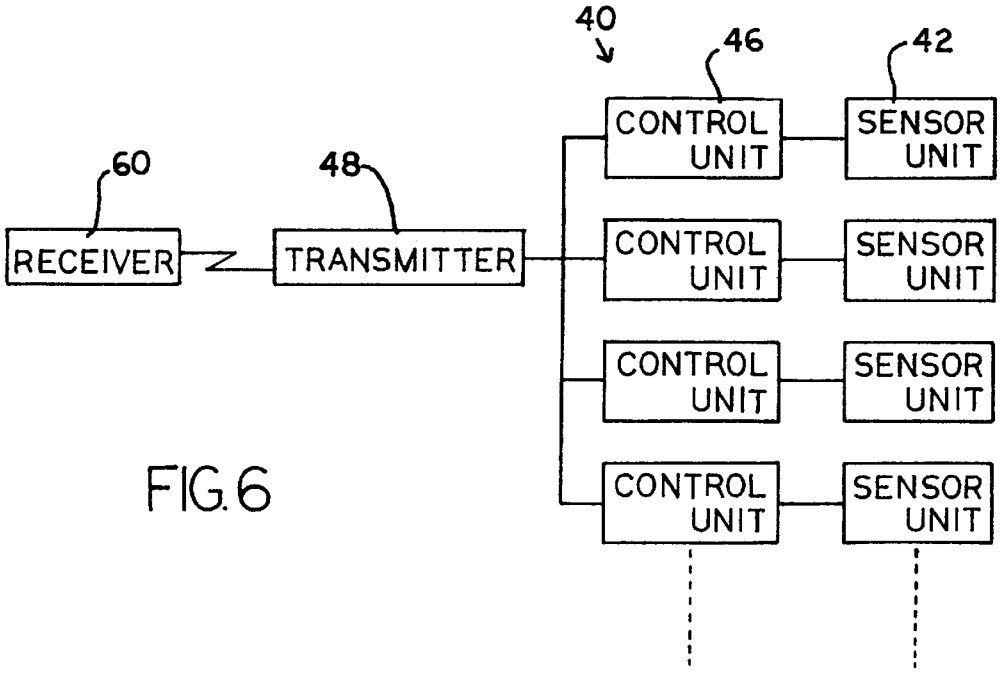
FIG. 6

SYSTEM FOR DETECTING THE PRESENCE OF INDIVIDUAL GOLF CLUBS IN A GOLF BAG

BACKGROUND OF THE INVENTION

1. Field of the Invention

The present invention relates to golf club monitoring systems and more particularly pertains to a new system for detecting the presence of individual golf clubs in a golf bag.

2. Description of the Prior Art

The use of golf club monitoring systems is known in the prior art. More specifically, systems have been proposed which are designed for association with golf bags or the golfer, and which typically have a component that mounted on the golf bag or golfer, and a plurality of components that are mounted directly on each of the golf clubs. The direct mounting of the components of the known systems on the golf clubs have required some damage or defacement to the golf clubs. Further, adding new clubs to the player's collection requires that a component be mounted on each added club for the system to be functional with respect to the added club. Also, any clubs that are replaced or otherwise removed from the collection must have the component removed from the club, or a new component must be obtained for the replacement club. Such component mounting directly on the club thus makes it difficult to add or subtract clubs from the collection if the system is to operative with respect to all clubs of the collection. And since typically the system component is mounted on the tip of the club grip, the system component is vulnerable to damage if the club is dropped on the tip of the club grip.

Some of the known systems have employed a continuous transmission of signals that consume large amounts of power and this requires bulky batteries or short operational periods of time.

The system for detecting the presence of individual golf clubs in a golf bag according to the present invention substantially departs from the conventional concepts and designs of the prior art, and in so doing provides a system that does not require the mounting of any specialized components on the golf clubs, and as a result can be used with virtually any club carried in a golf bag.

SUMMARY OF THE INVENTION

In view of the foregoing disadvantages inherent in the known types of golf club monitoring systems now present in the prior art, the present invention provides a new system for detecting the presence of individual golf clubs in a golf bag.

The general purpose of the present invention, which will be described subsequently in greater detail, is to provide a new system for detecting the presence of individual golf clubs in a golf bag.

To attain this, the present invention generally comprises a club monitoring device which is mountable in the interior of the golf bag for detecting the presence of at least one golf club in the interior of the golf bag. The club monitoring device comprises:

a plurality of sensor units, with each of the sensor units defining a gap for removably receiving one of the plurality of the golf clubs. A control unit is connected to each of the sensor units, and the control unit indicates when one of the sensor units does not detect the presence of a golf club in the gap defined by the sensor unit. The control unit is provided with an indicator for indicating that at least one of the sensor units does not detect the presence of a golf club in the associated club receiving member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new system for detecting the presence of individual golf clubs in a golf bag which does not require any physical modification to the golf clubs.

It is another object of the present invention to provide a new system for detecting the presence of individual golf clubs in a golf bag which does not require designating specific clubs for use with the system, and allows the player to swap out clubs for the needs of a specific round of golf or course.

It is a further object of the present invention to provide a new system for detecting the presence of individual golf clubs in a golf bag which is electrically efficient, and transmits only when a club has been removed rather than continuously.

An even further object of the present invention is to provide a new system for detecting presence of individual golf clubs in a golf bag which uses standard batteries rather than more expensive button type cells.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new system for detecting the presence of individual golf clubs in a golf bag according to the present invention.

FIG. 2 is a schematic perspective view of the golf bag insert of the present invention.

FIG. 3 is a schematic detail view of area 3 of FIG. 2.

FIG. 5 is a schematic perspective view of the control panel of the present invention.

FIG. 6 is a schematic functional block diagram of the present invention.

DESCRIPTION OF THE PREFERRED EMBODIMENT

Figure 4:
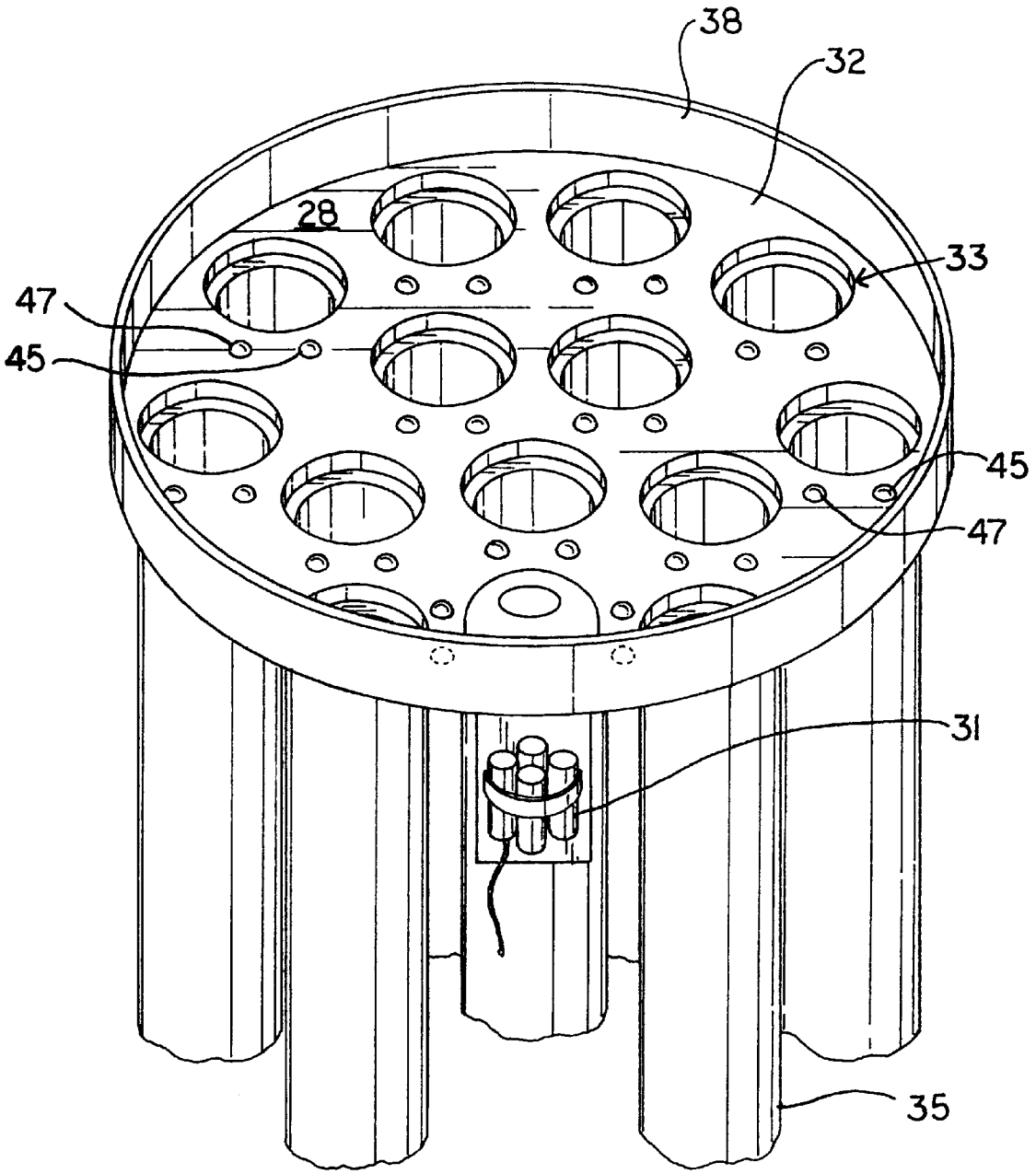
FIG. 4 is a schematic detail view of the upper support and control panel of the present invention.
Figure 7:
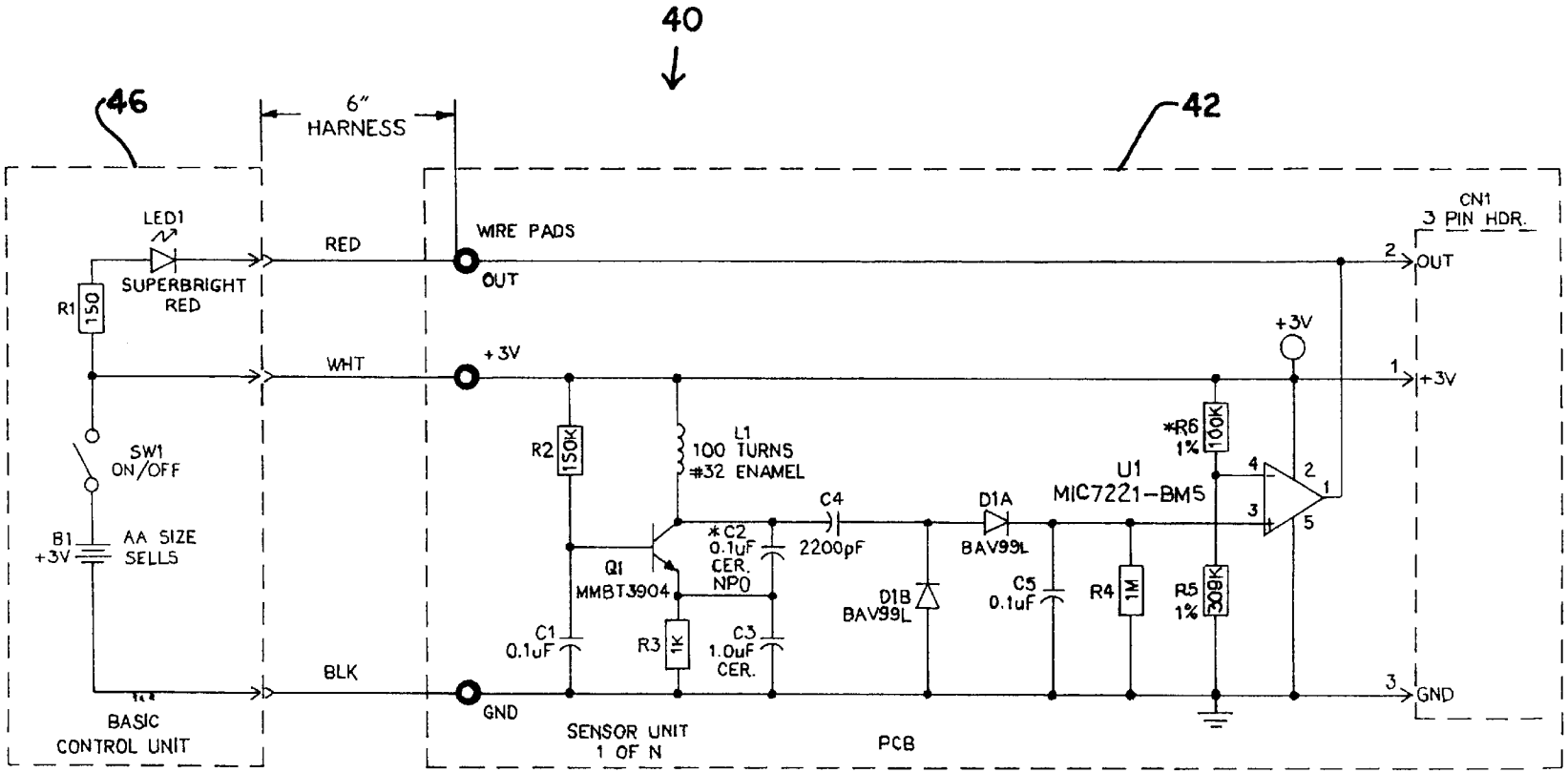
FIG. 7 is a schematic diagram of the sensor unit of the present invention.

With reference now to the drawings, and in particular to FIGS. 1 through 7 thereof, a new system for detecting the presence of individual golf clubs in a golf bag embodying the principles and concepts of the present invention and generally designated by the reference numeral 10 will be described.

As best illustrated in FIGS. 1 through 7, the system for detecting the presence of individual golf clubs in a golf bag 10 generally comprises a golf bag 20, a golf bag insert 30, a club monitoring means 40, and a receiver 60.

The golf bag 20 includes an interior. The golf bag includes opposite ends with a perimeter wall extending between the ends. A first one 22 of the ends is an open end and a second one 24 of the ends is a closed end. The golf bag 20 preferably has a substantially cylindrical shape, with the open end 22 being substantially circular.

The golf bag insert 30 is removably mounted in the interior of the golf bag 20. The golf bag insert 30 may include an upper support 32, a plurality of club receiving members 34, and a positioning plate 36.

The upper support 32 is positioned in the interior of the golf bag 20. The upper support 32 has an upper surface 28 and a lower surface (not shown). The upper support 32 includes a collar 38 that is mounted on a perimeter of the upper support 32 and extends from the upper surface 28 for positioning the collar adjacent to an inner surface of the perimeter wall of the golf bag 20. A control panel 39 is preferably formed on a portion of the upper surface 28 of the upper support 32. The control panel 39 is most preferably located adjacent to the collar 38 on the upper support 32. The upper support 32 includes a plurality of apertures 33.

Each of the plurality of club receiving members 34 is designed to receive a golf club 2. Each of the club receiving members 34 is mounted on the upper support 32. Each of the club receiving members 34 comprises a tubular member 35 with a lumen for receiving a golf club 2. The tubular member 35 includes an upper end 26 and a lower end 27. The upper end 26 of the tubular member 35 is mounted on the upper support 32 such that the lumen of the tubular member 35 is in communication with one of the plurality of apertures 33 in the upper support 32. Thus, insertion of a golf club shaft through one of the apertures 33 of the upper support 32 places the shaft in an associated tubular member 35. The lower end 27 of the tubular member 35 is free.

The positioning plate 36 may be provided for positioning portions of the club receiving members 34 with respect to each other. The positioning plate 36 is spaced from the upper support 32. The positioning plate 36 includes a plurality of apertures 39. Each of the apertures 39 receives one of the club receiving members 34.

The club monitoring means 40 is provided for detecting the presence of golf clubs 2 in the club receiving members 34. The club monitoring means 40 is mounted in the interior of the golf bag 20. The club monitoring means 40 preferably comprises a plurality of sensor units 42, at least one control unit 46, and a transmitter 48.

Each of the plurality of sensor units 42 is associated with one of the club receiving members 34 for detecting the presence (or absence) of one of the plurality of golf clubs 2 in the club receiving member 34. Each of the sensor units 42 defines a gap for removably receiving one of the plurality of the golf clubs 2. The gap may be defined by an annular ring 44. The annular ring 44 is formed by a coiled length of a conductor or conductive material. The coiled conductor is most preferably looped about the tubular member 35 of the club receiving assembly 34.

The control unit 46 is connected to at least one of the sensor units 42, and a single control unit 46 may be connected to all of the sensor units 42. The control unit 46 indicates when one of the sensor units 42 does not detect the presence of a golf club 2 in the associated club receiving member 34. The control unit may include at least one battery 31.

In one embodiment, the control unit 46 has a light 47 for indicating that at least one of the sensor units 42 does not detect the presence of a golf club 2 in the associated club receiving member 34.

In one embodiment of the invention, a control unit 46 is associated with each of the sensor units 42 such that each of the control units 46 provides an indication when the associated sensor unit 42 does not detect the presence of a golf club 2 in the associated club receiving member 34. Each of the control units 46 may include a power switch 45 for selectively providing power to the sensor units 42 such that individual sensor units 42 may be turned off when the associated club receiving member 34 is not needed to hold a golf club 2. This feature permits the invention to be adjusted to the particular number of clubs used by a golfer during a particular round of golf.

The transmitter 48 is operatively connected to the control unit 46. The transmitter 48 transmits a club down signal when one of the sensor units 42 associated with the control unit 46 does not detect the presence of a golf club 2 in the associated club receiving member 34. The club down signal is most preferably transmitted wirelessly.

The receiver 60 may be provided to be worn by a golfer. The receiver 60 is designed to receive a wireless transmission of the club down signal from the transmitter 48. The receiver 60 includes a clip member for attaching the receiver 60 to a belt 4 worn by the golfer.

In one embodiment of the invention, the receiver 60 is provided with a housing 62, which has a series of indicators lights 66 positioned on a face 64 of the housing 62. Each of the indicator lights 66 corresponds to a specific tubular member 35. Because each of the tubular members 35 is associated with a specific golf club 2, selected by the golfer for that round of golf and placed in the tubular member 35, each of the indicator lights 66 on the receiver housing 62 corresponds to a specific golf club 2. The club down signal from transmitted by the transmitter 48 is encoded to indicate which club(s) 2 is absent from the corresponding tubular member(s) 35. The receiver 60 decodes the club down signal and the appropriate light(s) 66 on the face 64 of the receiver housing 62 is illuminated providing the golfer with a visual indication of the missing club(s) 2.

In one embodiment of the invention, the receiver 60 is designed to emit a sound in response to receipt of the club down signal from the transmitter 48, thus alerting the golfer audibly to a missing club 2.

Optionally, the receiver 60 is designed to create a vibration of the housing of the receiver 60 in response to receipt of the club down signal from the transmitter 48, thus providing a tactile, discreet reminder to the golfer that a club is missing from the bag.

Illustrative examples of the receiver 60 and transmitter 48 are the LMX3161 transceiver available from National Semiconductor Corporation, Santa Clara, Calif., and the RF105 or RF109 transceivers available from Conexant Systems, Inc, Newport Beach, Calif. Any of these three devices or similar devices well known to those skilled in the art provides 3-volt, low current consumption, RF to baseband digital processing suitable for the application described above. Any of the transceivers can be configured as a receiver only or a transmitter only.

In one embodiment the system the same version of transceiver is utilized for both the transmitter 48 and the receiver 60, thus manufacturing component costs are minimized.

In use, the golf bag insert is inserted into the interior of a golf bag. Each of the golf clubs in the set of golf clubs to be carried in the golf bag is inserted into the associated club receiving member. The power switch associated with each of the club receiving members which have received a golf club is placed in the ON position. Thus power is applied to the appropriate sensor units. The system is now enabled to detect the presence or absence of each individual golf club from the associated golf club receiving member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for detecting the presence of golf clubs in a golf club holding bag, comprising:

a golf bag having an interior, the golf bag having opposite ends with a perimeter wall extending between the ends, a first one of the ends being an open end and a second one of the ends being a closed end, the golf bag having a substantially cylindrical shape with the open end being substantially circular;

a golf bag insert mounted in the interior of the golf bag, the insert comprising:

an upper support positioned in the interior of the golf bag, the upper support having an upper surface and a lower surface, the upper support having a collar mounted on a perimeter of the upper support and extending from the upper surface for positioning adjacent an inner surface of the perimeter wall of the golf bag, a control panel being formed on a portion of the upper surface of the upper support, the control panel being located adjacent the collar on the upper support, the upper support having a plurality of apertures formed therein;

a plurality of club receiving members, each of the club receiving members being adapted to receive a golf club therein, each of the club receiving members being mounted on the upper support, each of the club receiving members comprising a tubular member having a lumen for receiving a golf club, the tubular member having an upper end and a lower end, the upper end of the tubular member being mounted on the upper support such that the lumen of the tubular member is in communication with one of the plurality of apertures in the upper support, the lower end of the tubular member being free;

a positioning plate for positioning portions of the club receiving members with respect to each other, the positioning plate being spaced from the upper support, the positioning plate having a plurality of apertures, each of the apertures receiving one of the club receiving members;

club monitoring means for detecting the presence of golf clubs in the club receiving members, the club monitoring means being mounted on the golf bag, the club monitoring means comprising:

a plurality of sensor units, each of the sensor units being associated with one of the club receiving members for detecting the presence of one of the plurality of golf clubs in the club receiving member, each of the sensor units defining a gap through which one of the plurality of the golf clubs is removably insertable, each of the sensor units sensing whether one of the plurality of golf clubs is inserted in the gap of the sensor unit, the gap being defined by an annular ring, the annular ring being formed by a coiled conductor, the coiled conductor being looped about the tubular member of the club receiving assembly;

a control unit connected to each of the sensor units, the control unit indicating when one of the sensor units does not detect the presence of a golf club in the associated club receiving member, wherein the control unit has a light for indicating that at least one of the sensor units does not detect the presence of a golf club in the associated club receiving member, wherein a control unit is associated with each of the sensor units such that each of control units provides an indication when the associated sensor unit does not detect the presence of a golf club in the associated club receiving member, each of the control units having a power switch for selectively providing power to the sensor units such that individual sensor units may be turned off when the associated club receiving member is not needed to hold a golf club;

a transmitter operatively connected to the control unit, the transmitter transmitting a club down signal when on eof the sensor units associated with the control unit does not detect the presence of a golf club in the associated club receiving member; and a receiver for being worn by a golfer, the receiver being adapted to receive a transmission of the club down signal from the transmitter, wherein the receiver is adapted to emit a sound in response to receipt of the club down signal from the transmitter, wherein the receiver is adapted to create a vibration of a housing of the receiver in response to receipt of the club down signal from the transmitter.

2. An apparatus for detecting the presence of golf clubs in a golf club holding bag, the golf club holding bag having an interior, the apparatus comprising:

a club monitoring device mountable in the interior of the golf bag for detecting the presence of at least one golf club in the interior of the golf bag, the club monitoring device comprising:

a plurality of sensor units, each of the sensor units defining a gap for removably receiving one of the plurality of the golf clubs; and a control unit connected to each of the sensor units, the control unit indicating when one of the sensor units does not detect the presence of a golf club in the gap defined by the sensor unit, wherein the control unit has an indicator for indicating that at least one of the sensor units does not detect the presence of a golf club in the associated club receiving member;

a transmitter operatively connected to the control unit, the transmitter transmitting a club down signal when one of the sensor units associated with the control unit does not detect the presence of a golf club in the gap associated with the sensor unit;

a portable unit for being worn by a golfer, the portable unit comprising:

a receiver being adapted to receive a transmission of the club down signal from the transmitter; and notification means for notifying the golfer when the club down signal is received by the receiver.

3. The apparatus of claim 2 wherein a control unit is associated with each of the sensor units such that each of control units provides an indication when the associated sensor unit does not detect the presence of a golf club in the associated gap defined by the sensor unit.

4. The apparatus of claim 2 wherein each of the control units has a power switch for selectively providing power to each of the sensor units such that individual sensor units may be turned off when a golf club is not to be removably inserted in the gap associated with the sensor unit.

5. The apparatus of claim 2 wherein the notification means is adapted to emit a sound in response to receipt of the club down signal by the receiver from the transmitter.

6. The apparatus of claim 2 wherein the notification means is adapted to create a vibration of a housing of the portable unit in response to receipt of the club down signal by the receiver from the transmitter.

7. The apparatus of claim 2 additionally comprising a golf bag insert mountable in the interior of the golf bag, the insert including an upper support positioned in the interior of the golf bag, the upper support having an upper surface and a lower surface.

8. The apparatus of claim 7 wherein the upper support has a collar mounted on a perimeter of the upper support and extending from the upper surface for positioning adjacent an inner surface of the perimeter wall of the golf bag.

9. The apparatus of claim 7 additionally comprising a control panel being formed on a portion of the upper surface of the upper support.

10. The apparatus of claim 7 wherein the upper support has a plurality of apertures formed therein.

11. The apparatus of claim 2 additionally comprising a golf bag insert mountable in the interior of the golf bag, the insert including a plurality of club receiving members, each of the club receiving members being adapted to receive a golf club therein.

12. The apparatus of claim 11 wherein each of the club receiving members is mounted on an upper support of the golf bag insert.

13. The apparatus of claim 11 wherein each of the club receiving assemblies comprises a tubular member having a lumen for receiving a golf club, the tubular member having an upper end and a lower end.

14. The apparatus of claim 11 wherein each of the sensor units is associated with one of the club receiving members for detecting the presence of one of the plurality of golf clubs in the club receiving member, the gap of the sensor unit being defined by a wall of the associated club receiving member.

15. The apparatus of claim 13 wherein the gap is defined by an annular ring, the annular ring being formed by a coiled conductor looped about the tubular member of the club receiving assembly.

16. The apparatus of claim 11 wherein the insert includes a positioning plate for positioning portions of the club receiving members with respect to each other, the positioning plate having a plurality of apertures, each of the apertures receiving one of the club receiving members.

* * * * *